United States Patent [19]

Norris

[11] 4,304,654

[45] Dec. 8, 1981

[54] APPARATUS FOR ELECTROPLATING

[75] Inventor: Joseph C. Norris, Mayfield Heights, Ohio

[73] Assignee: Sifco Industries, Inc., Cleveland, Ohio

[21] Appl. No.: 200,219

[22] Filed: Oct. 24, 1980

[51] Int. Cl.[3] ..... C25D 17/14

[52] U.S. Cl. ..... 204/212; 204/224 M; 204/279; 204/297 R

[58] Field of Search ..... 204/212, 224, 279, 297

[56] References Cited

U.S. PATENT DOCUMENTS

| | | | |
|---|---|---|---|
| 3,506,558 | 4/1970 | Nagel et al. | 204/212 |
| 3,743,590 | 7/1973 | Roll | 204/212 |
| 3,853,734 | 12/1974 | Ellis et al. | 204/212 |
| 3,939,053 | 2/1976 | Diepers et al. | 204/212 |

*Primary Examiner*—Arthur C. Prescott

*Attorney, Agent, or Firm*—Pearne, Gordon, Sessions, McCoy & Granger

[57] ABSTRACT

An apparatus for electrolytically plating, cleaning, or otherwise treating a surface of revolution of a metallic workpiece. The treatment is carried out by a pair of electrodes each having a conductive portion and a porous dielectric cover that engages the surface to be treated. The electrodes are resiliently supported by an arm that is mounted on a shaft that is coaxial with the surface of revolution to be treated. The arm has portions extending radially outwardly from the shaft, each portion being provided with a resilient member to which an electrode is secured so that when the shaft is rotated the electrodes are moved in a circular path and are resiliently urged into engagement with the surface to be treated. Means are provided for supplying electrolyte to the electrodes and for supplying electric current to the workpiece and the electrodes to carry out the electrolytic treatment.

8 Claims, 7 Drawing Figures

APPARATUS FOR ELECTROPLATING

BACKGROUND OF THE INVENTION

This invention relates to an apparatus for electrocleaning and electroplating metallic surfaces and, more particularly, to an apparatus for carrying out electrolytic cleaning and electroplating operations in which the surface to be plated is subjected to a rubbing or brushing action as the electrolytic action takes place. Apparatus for brush plating of metal is well known in the art, and usually takes the form of a hand tool which is rubbed or brushed against the surface to be plated as electrolytic action takes place. In the usual form, the tool has a terminal which is made anodic with respect to a workpiece for plating and cathodic for electroetching or electrocleaning. The conductive terminal is encased in a porous dielectric fabric that is saturated with electrolyte and rubbed over the surface to be treated.

Brush plating has ordinarily been carried out with hand tools, but difficulties are encountered in such operations because of non-uniformity of deposition of metals and because the brush plating operation may be tedious and time-consuming when relatively large areas are involved.

Apparatus for brush cleaning and brush plating relatively small areas, such as the inner surfaces of small bores, have been successfully used, apparatus of this type being shown in U.S. Pat. Nos. 3,183,176 and 3,313,715, both granted to B. A. Schwartz, Jr. A power-operated, manually controlled tool for brush electroplating is also shown in U.S. Pat. No. 3,751,343, issued to A. J. Macula et al. The methods and apparatus of these patents have been utilized successfully to produce high quality brush plating, but they have not been adaptable to the brush plating of large areas because the hand operation is not only expensive, because of the time involved, but also the quality of the plating may vary and the thickness of the plating in various parts of the same surface may vary considerably.

SUMMARY OF THE INVENTION

It is therefore a general object of the present invention to provide an improved brush electroplating apparatus particularly adapted to the plating of surfaces of such large areas that it is impractical to plate them by hand because of the time and expense involved and the non-uniformity of the result, and also to provide apparatus capable of plating surfaces of larger sizes than can be plated expeditiously and with the production of high quality platings by devices of the type disclosed in the aforesaid Schwartz U.S. Pat. No. 3,183,176 in which the rubbing pressure is obtained by the action of centrifugal force on parts of the tool.

Another object is the provision of an apparatus whereby electrolytic cleaning and electroplating operations can be carried out by machine rapidly and efficiently, and at low cost.

Another object is the provision of an apparatus particularly adapted to electrocleaning and electroplating the interior surface of large cylinders and bores, the exterior surfaces of large cylindrical members, and other surfaces of revolution such as plane annular surfaces and conical surfaces.

A further object is the provision of an apparatus whereby uniform and high quality electroplating can be produced at high rates of deposition and production and at reasonable cost. Another object is the provision of an apparatus embodying such advantages that can be manufactured and operated at reasonable cost and that does not require great skill on the part of the operator.

Briefly, these and other objects and advantages of the invention are obtained by providing an apparatus embodying a central, rotatable, tubular member and bearings for supporting the tubular member upon an appropriate base, a motor for driving the tubular member at a substantially constant speed, one or more support arms extending radially outwardly from and secured to the tubular member, each support arm carrying at its end remote from the tubular member an electrically conductive tool having a porous dielectric surface that is shaped to conform to the contour of the surface to be plated. A pump and appropriate conduits are provided to supply electrolyte to the tools, the tools being supported by resilient means that resiliently urge the porous dielectric surface of each tool into contact with the surface to be treated, and the hollow tubular member being rotated to carry the tools in circular paths about the axis of the tubular member which is also the axis of the surface of revolution being cleaned or plated or otherwise treated. A conventional power supply embodying voltage control means and appropriate meters is provided to supply direct current to the apparatus. The workpiece is supported with the axis of the surface thereof to be treated coaxial with the tubular member and the electrical connections are such that, in electroplating operations, the workpiece constitutes the cathode and the tools the anodes in the electroplating circuit. The resilient support for the tools ensures that the pressure exerted by the tools on the workpiece is substantially uniform throughout the area of the tools and throughout each revolution of the tools about the axis of the workpiece. The tools are moved at uniform speed, and therefore the plating is uniform throughout the area being plated.

As noted above, the apparatus may be utilized to plate internal surfaces of large bores, external cylindrical surfaces, and other surfaces of revolution. The invention is disclosed herein with particular reference to electroplating, since it is in this operation that large savings in time and cost and improved results can be obtained. However, it is to be understood that, if desired, the apparatus can be adapted to electrocleaning and electroetching, and that these operations are included in the term "electrolytic treatment" as used hereinafter.

DESCRIPTION OF THE PREFERRED EMBODIMENTS

Figure 1:
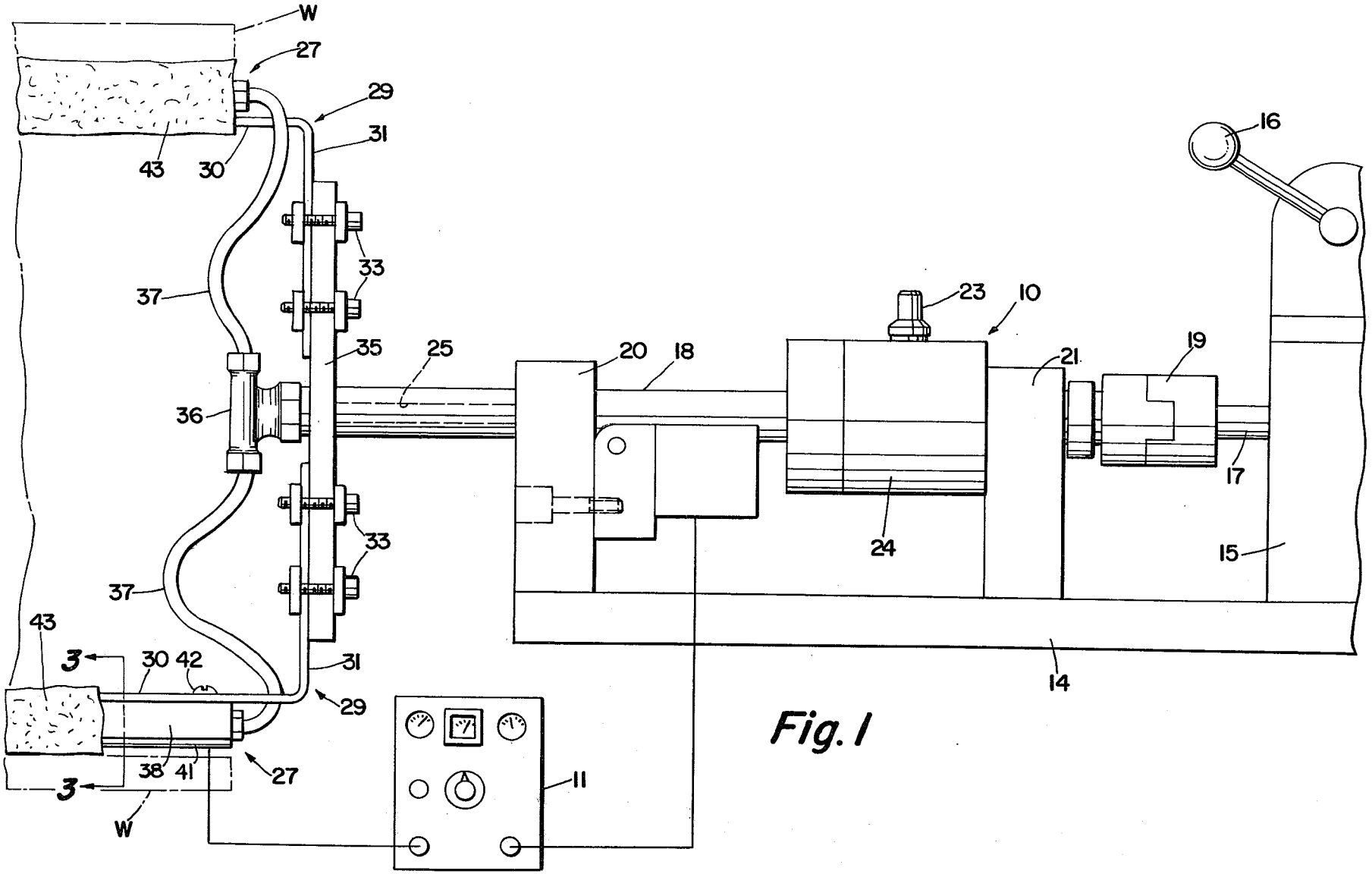
FIG. 1 is a side elevation, partially in section, illustrating a preferred form of the apparatus as adapted to electrolytically treating an internal bore.
Figure 2:
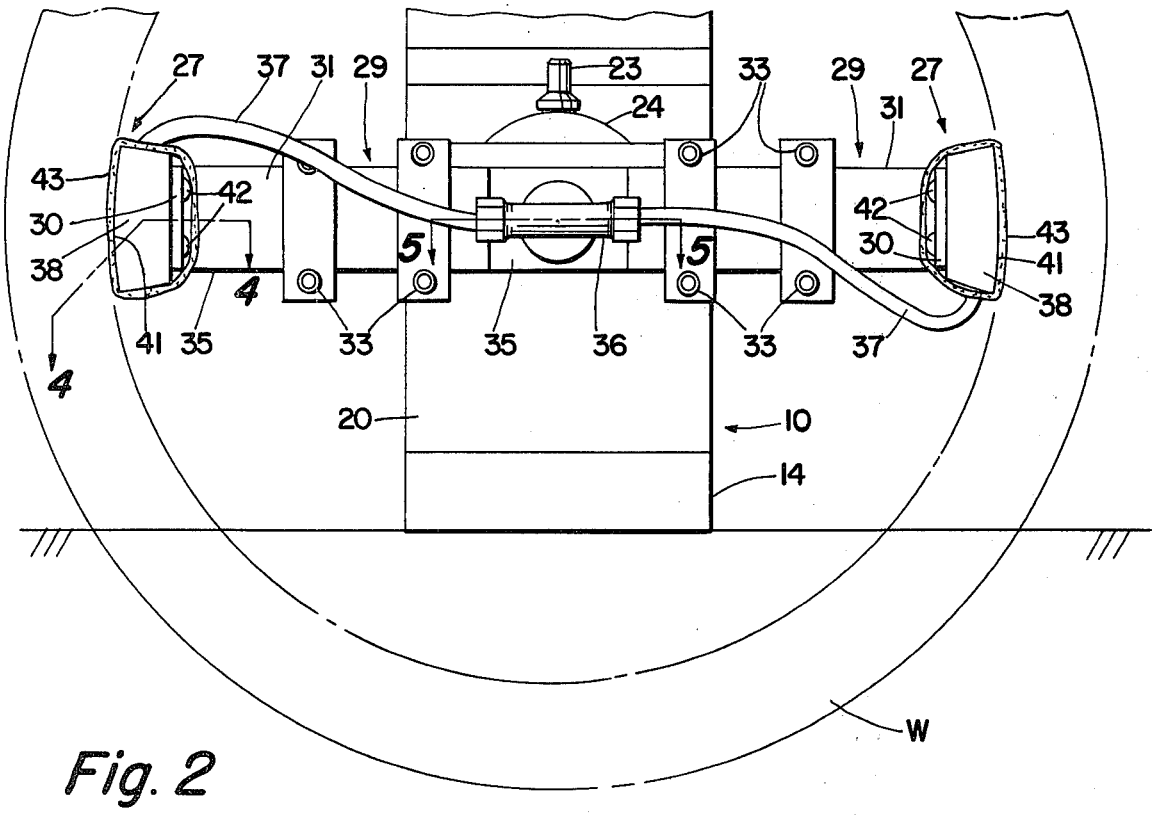
FIG. 2 is an end elevation of the apparatus shown in FIG. 1.
Figure 3:
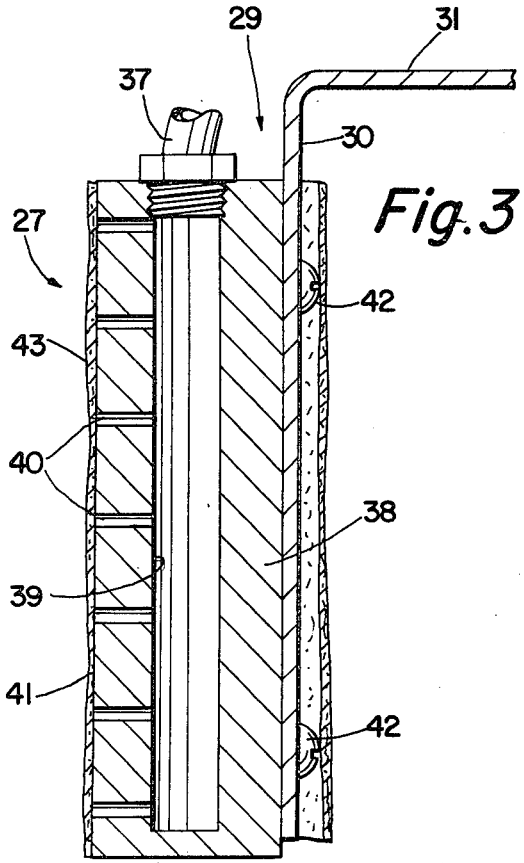
FIG. 3 is a transverse section, to an enlarged scale, through one of the anode tools taken as indicated by line 3—3 of FIG. 1.
Figure 4:
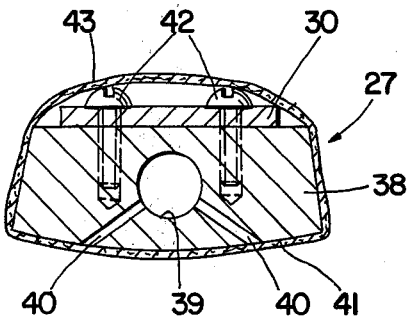
FIG. 4 is an enlarged, sectional detail of the anode tool shown in FIG. 3, the section being taken as indicated by line 4—4 of FIG. 2.
Figure 5:
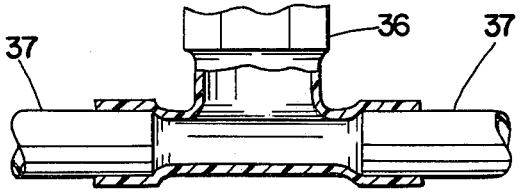
FIG. 5 is a detail, partly in section, showing a T-connection employed to distribute electrolyte to the anode tools.

A preferred form of apparatus embodying the invention is indicated in general at 10 in FIG. 1 of the drawing. A conventional power source is shown at 11, and the apparatus is shown as adapted to plate an internal cylindrical bore 12 of a workpiece W, only a portion of which is illustrated. In electroplating, the negative lead from the power supply is connected by conventional conductors and connections to the workpiece W, while the positive lead is connected to the apparatus and thence to the electrode tools, as described below.

The apparatus preferably is supported on a base 14, preferably protected by a corrosion-resistant plastic material, such as polypropylene. The base supports a conventional gear reduction drive motor, indicated at 15, and controlled by an appropriate switch operated by the handle 16. The output shaft 17 of the motor drives a hollow shaft 18 through a conventional coupling 19, the shaft 18 being supported from the base by conventional bearings indicated at 20 and 21. The hollow shaft 18 supplies electrolyte to the electroplating tools, as described below, and is in itself supplied with electrolyte through the conduit 23 and a swivel fluid connection 24 that is supported by the bearing 21. Connection 24 may be of any conventional construction, and is arranged to supply electrolyte. Electrolyte is supplied to conduit 23 by a conventional pump (not shown) that pumps electrolyte from a conventional reservoir (not shown) to the interior passage 25 of the hollow shaft 18, seals being provided to prevent leakage of electrolyte at the ends of the fitting where the shaft enters and leaves the fitting. The apparatus and the workpiece are set up so that the axes of the shaft 18 and the bore 12 are precisely aligned and concentric.

The electroplating operation is carried out by a pair of identical anode plating tools 27, each tool being supported by an angular spring bracket 29, each bracket having an axially extending portion 30 to which the work engaging portion of the tool 27 is secured and a radially extending portion 31. The portions 31 of the brackets 29 are secured as by bolts 33 to a cross member 35 that is secured to the shaft 18 as by welding or brazing at the juncture 36. Thus, when the motor 15 is operated, rotation of the tubular shaft 18 carries the tools 27 in a circular path that is concentric with the internal bore 12 that is to be plated. The brackets 29 are of resilient material, such as stainless steel, and the axially extending portions 30 of the brackets act as leaf springs urging the tools against the bore. By proper design of the brackets and adjustment of the portions 31 of the brackets on the cross member 35, the desired rubbing pressure can be applied by the electrode tools against the internal cylindrical surface to be plated. Electrolyte is supplied to the electrode tools through the passage 25 in the tubular member 18 to a T-connection 36 through which electrolyte is supplied to the respective electrode tools 27 through flexible tubes 36.

The electrode tools 27 are preferably formed from graphite blocks 38, each block having an axially extending bore 30 that is intersected by a plurality of spaced, relatively small diameter bores 40 that extend from the axially extending bore to the exterior arcuate surface 41 of the block that is disposed adjacent the cylindrical surface of the workpiece in operation. A fitting 42 threaded into the bore 39 of each block is employed to connect the tubes 36 to the bores 39. The graphite blocks 38 are secured to the leaf springs 30 by screws 42 that are threaded in the blocks.

In order to provide the required porous insulation for the anode tools, the surfaces of the graphite blocks 38 are preferably provided with covers 43 composed of Dacron polyester felt having a thickness of about $\frac{1}{8}$ inch. The felt extends over the arcuate surface 41 of the graphite, and the edges of the felt that extend over the leaf spring 30 are laced to each other to retain the cover in place on the graphite. Any convenient type of lacing can be employed. The lacing is not illustrated in the drawings.

In use, the apparatus 14 and the workpiece W are properly aligned with each other, the brackets 29 being adjusted on the cross member 35 so that the desired resilient pressure is exerted by the polyester felt covers on the interior of the bore to be plated. The pump is started to supply electrolyte to the electrodes, the motor is turned on to rotate the apparatus to give the desired lineal speed of rubbing between the anodes and the workpiece, and the power supply is adjusted to give the desired current density.

With the usual brush plating electrolyte, the pressure exerted by the anode on the workpiece is approximately 0.5 psi. With bores having diameters of from 4 to 12 inches, a rotational speed of 30 rpm gives satisfactory rubbing speeds of from about 32 to 95 feet per minute to the anode tools 27. The radius of curvature of the graphite blocks is such that the radius of curvature of the covers or pads that engage the surface to be plated is very close to the radius of curvature of that surface.

The graphite blocks are proportioned for particular size bores. For example, for a bore 12.875 inches in diameter by 4.5 inches long, blocks about 4 inches wide would be employed, having a length equal to the length of the bore to be plated, so that the entire area of the bore to be plated is covered in each revolution of the anodes. The radius of the blocks is slightly less than the radius of the bore to be plated, so that the total radius of the blocks plus the thickness of the cover is about equal to the radius of the bore that is being plated.

With the usual electrolytes, a current density of about 6 amperes per square inch is satisfactory, the power supply having sufficient capacity to deliver about 200 amperes. With apparatus of the range of sizes noted above, an electrolyte flow of about two gallons per minute is satisfactory. The operator observes the ampere/hour meter of the power supply to determine when the electrolytic deposition has taken place for a long enough period of time to produce a deposit of the required thickness. The operator also observes the nature of the deposit to determine that a deposit of the required character is being produced. For example, if there is an indication of burning, he reduces the applied voltage and current density.

A high quality copper plate having a thickness of about 0.0035 inches can be produced in a bore having the dimensions given above in 20 to 30 minutes by the use of the apparatus of the present invention. A similar bore would require three to four hours for hand plating and the deposit would not be as uniform as that obtained by the machine.

The apparatus can also be utilized for electrocleaning by utilizing appropriate electrolytes and making the workpiece the anode in the circuit. However, electrolytic cleaning can be carried out rapidly by hand, and therefore the use of the machine is not as advantageous in cleaning as it is in plating.

Figure 6:
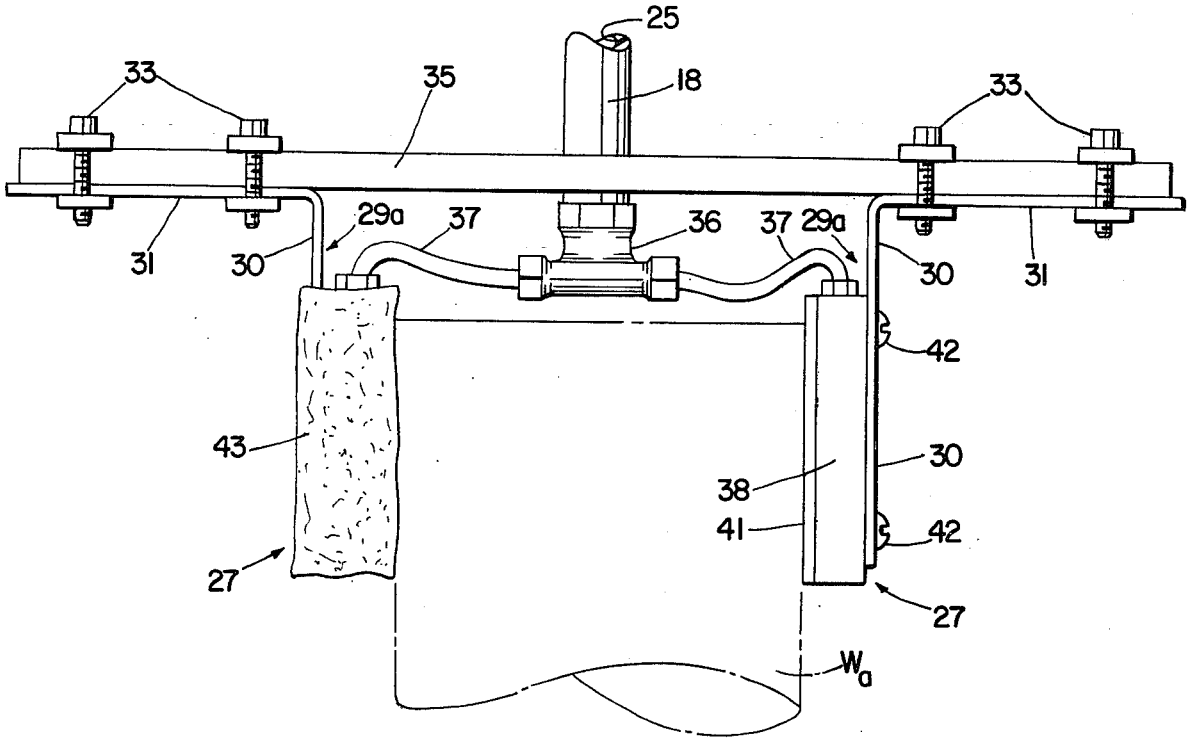
FIG. 6 is a side elevation of an apparatus made according to the invention and modified to electroplate or otherwise electrolytically treat the exterior of a cylindrical workpiece.

FIG. 6 of the drawings shows an adaptation of the machine for plating the exterior of a cylindrical member. The underlying parts of the machine are essentially the same as shown in FIG. 1, except that the radially extending cross member 35*a* is substantially longer than the member 35 of FIG. 1 and the spring brackets 29*a* are reversed as compared to the brackets 29 of FIG. 1. The anodes 27*a* extend inwardly from the axially extending portions 30*a* of the leaf spring brackets 29*a* so that the anode pads are resiliently urged into engagement with the outer surface of the cylindrical workpiece Wa. The surface of the graphite portion of the anodes is concave to conform to the exterior surface of the workpiece Wa. The cover of one of the anodes has been removed in this figure for purposes of illustration. The operation of the apparatus is essentially the same as that previously described.

Figure 7:
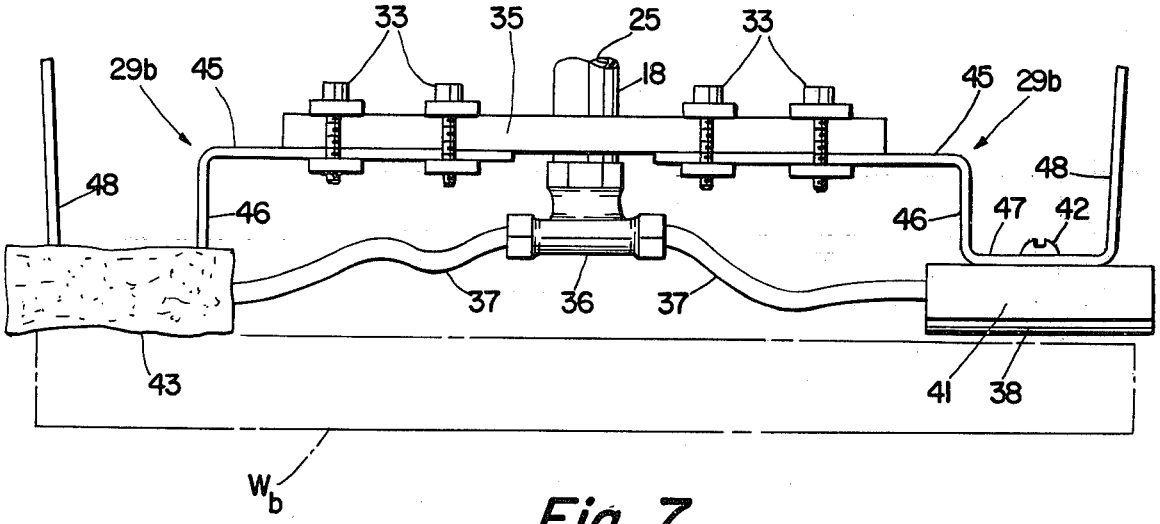
FIG. 7 is a side elevation of an apparatus made according to the invention and modified to electroplate or otherwise electrolytically treat a flat annular surface of a workpiece.

FIG. 7 shows an apparatus, again having the same basic parts, that is adapted to plate an annular surface on a workpiece Wb. Here, the resilient brackets 29*b* have radially extending portions 45 and axially extending portions 46 that serve to offset additional radially extending portions 47 from the radially extending portions 45 of the brackets. The brackets are terminated by axially extending portions 47, which the operator can grasp if he desires to move the anodes away from the workpiece against the action of the spring brackets. The anodes 29*b*, like the anodes previously described, consist of graphite blocks provided with porous dielectric covers preferably composed of polyester felt. The surfaces of the graphite blocks adjacent the workpiece, however, are flat, so that the surfaces of the dielectric cover that engage the workpiece are also flat. The cover of one of the anodes has been removed in this figure for purposes of illustration. The operation is essentially the same as previously described, this modification of the invention being particularly advantageous when it is desired to electroplate fairly large, flat, annular surfaces.

It is to be noted that the resilient supports for the anodes, in each of the forms of the invention, insure the production of high quality work, even though there may be some misalignment or eccentricity between the workpiece and the shaft 18 that carried the anodes in their orbital path. The resilient supports also compensate for normal wear of the tool covers and thereby insure work of good quality.

From the foregoing description of the preferred forms of my invention, it will be seen that I have provided a simple and effective apparatus whereby brush plating of internal cylindrical bores, external surfaces, flat annular surfaces, and other surfaces of revolution can be rapidly and economically plated with the production of high quality electrodeposited coatings.

What is claimed is:

1. Apparatus for electrolytically treating a surface of revolution on a metallic workpiece, said apparatus comprising a shaft, bearings for supporting said shaft on the axis of said surface of revolution, means for rotating said shaft, an arm extending radially outwardly from said shaft, a resilient member supported by said arm, a conductive electrode carried by said resilient member, said electrode having a surface covered by a porous dielectric cover and being shaped to conform to a segment of said surface of revolution, said resilient member resiliently urging said surface of said electrode into engagement with said surface of revolution, rotation of said shaft carrying said electrode over said surface of revolution with said cover rubbing said surface, conduits for supplying electrolyte to said electrode and the cover thereof, a source of unidirectional electric current, and means for connecting one terminal of said source to said workpiece and the other terminal of said source to said electrode.

2. Apparatus according to claim 1, wherein said shaft has an axially extending passage therein, means for supplying electrolyte to the passage in said shaft, said conduits conducting electrolyte from said passage to said electrode.

3. Apparatus according to claim 1 or claim 2, having a pair of said arms extending radially outwardly in opposite directions from said shaft and an electrode carried by each arm.

4. Apparatus for electroplating a surface of revolution on a metallic workpiece, said apparatus comprising a conductive shaft having an axially extending passage therethrough, bearings for supporting said shaft, means for rotating said shaft, means for supplying electrolyte to the passage in said shaft, an arm extending radially outwardly from said shaft, a resilient member supported by said arm, a conductive electrode carried by said resilient member, said electrode having a surface covered by a porous dielectric cover and shaped to conform to a segment of said surface of revolution, said shaft being disposed on the axis of said surface of revolution, said resilient member resiliently urging said surface of said electrode into engagement with said surface of revolution, rotation of said shaft carrying said electrode over said surface of revolution with said cover rubbing said surface, means for supplying an electrolyte to said electrode and cover thereof, said means comprising means for supplying electrolyte to the passage in said shaft and conduits extending from said shaft to said electrode and cover thereof, a source of unidirectional electric current, means for connecting the positive terminal of said source to said electrode, and means for connecting the negative terminal of said source to said workpiece.

5. Apparatus according to claim 4, wherein the connection of said source of electric current to said electrode is through said shaft, said arm, and said resilient member to said conductive electrode.

6. Apparatus according to claim 1 or claim 4, wherein the surface of revolution is an internal cylindrical surface and wherein said electrode has a convex, cylindrical surface shaped to conform to a segment of said internal cylindrical surface.

7. Apparatus according to claim 1 or claim 4, wherein said surface of revolution is an external cylindrical surface and said electrode has a concave cylindrical surface shaped to conform to the external cylindrical surface of the workpiece.

8. Apparatus according to claim 1 or claim 4, wherein said surface of revolution is a plane annular surface and said electrode has a plane surface conforming to a segment of said plane annular surface, said resilient member urging said electrode in a direction parallel to the axis of said shaft into engagement with said surface.

* * * * *